US010072877B2

(12) United States Patent
Toporis et al.

(10) Patent No.: US 10,072,877 B2
(45) Date of Patent: Sep. 11, 2018

(54) COOLING DEVICE

(71) Applicant: DIEHL DEFENCE GMBH & CO. KG, Ueberlingen (DE)

(72) Inventors: Stane Toporis, Maribor (SI); Tomaz Sarc, Kranj (SI); Robert Rid, Markdorf (DE); Franc Megusar, Selca (SI)

(73) Assignee: Diehl Defence GmbH & Co. KG, Ueberlingen (DE)

( * ) Notice: Subject to any disclaimer, the term of this patent is extended or adjusted under 35 U.S.C. 154(b) by 403 days.

(21) Appl. No.: 14/858,125

(22) Filed: Sep. 18, 2015

(65) Prior Publication Data

US 2016/0084537 A1 Mar. 24, 2016

(30) Foreign Application Priority Data

Sep. 18, 2014 (EP) ..... 14003245
Jan. 28, 2015 (EP) ..... 15000255

(51) Int. Cl.

| | |
|---|---|
| ***F25B 9/00*** | (2006.01) |
| ***F25B 9/02*** | (2006.01) |
| ***F25B 19/00*** | (2006.01) |
| ***F16K 31/02*** | (2006.01) |

(52) U.S. Cl.
CPC ..... *F25B 9/02* (2013.01)

(58) Field of Classification Search
CPC ..... Y10T 137/7737; F16K 31/002; F16K 31/025; F16K 99/0001; F16K 99/0044; F16K 2099/0084; F25B 9/02; F25B 19/00; F25B 19/005
See application file for complete search history.

(56) References Cited

U.S. PATENT DOCUMENTS 3,818,720 A * 6/1974 Campbell ..... F25B 9/02 62/51.2
6,016,659 A * 1/2000 Westhoven, Jr. ..... F25B 9/02 62/51.1
6,016,697 A * 1/2000 McCulloch ..... G01F 23/266 73/304 C

FOREIGN PATENT DOCUMENTS

| | | | | |
|---|---|---|---|---|
| EP | 0699880 A2 | 3/1996 | | |
| EP | 0699881 A2 * | 3/1996 | ..... | F25B 9/02 |
| GB | 1368107 A | 9/1974 | | |
| WO | 0218932 A1 | 3/2002 | | |
| WO | 2012049673 A2 | 4/2012 | | |

* cited by examiner

*Primary Examiner* — Erik Mendoza-Wilkenfe
(74) *Attorney, Agent, or Firm* — Laurence A. Greenberg; Werner H. Stemer; Ralph E. Locher

(57) ABSTRACT

A cooling device for cooling a detector element disposed in a jacket cavity of a Dewar vessel uses a Joule-Thomson cooler with an expansion nozzle that opens into an expansion chamber. The cooling device includes a final control element that is adjustable depending on temperature for influencing the flow through the expansion nozzle. A first temperature sensor is disposed in the expansion chamber and a second temperature sensor is disposed within the Dewar vessel outside the expansion chamber. The cooling device includes a control device that is configured for detecting a temperature gradient from sensor values of the first temperature sensor and of the second temperature sensor and for adjusting the final control element depending on the detected temperature gradient.

7 Claims, 1 Drawing Sheet

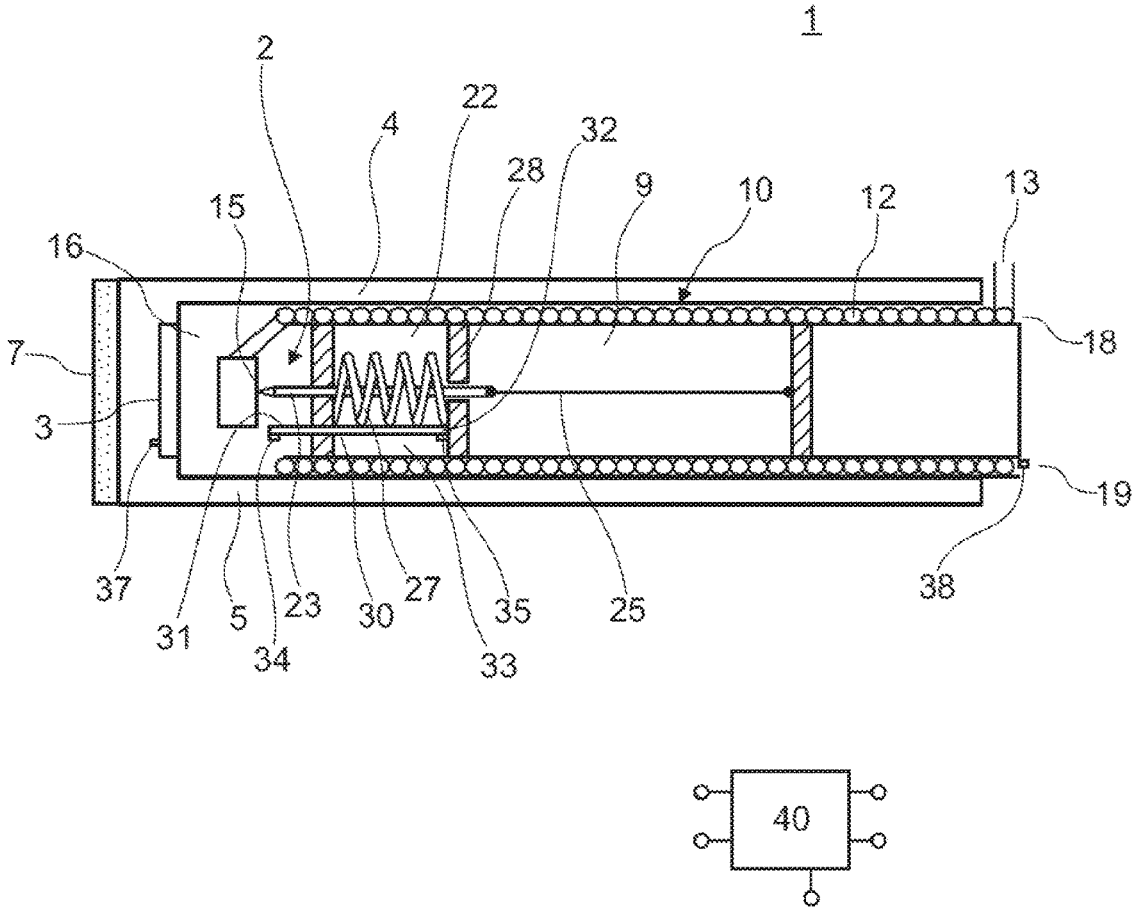
1
2
22
4
32
28
9
10
12
13
15
16
18
7
3
19
37
31
5
23
30
27
35
25
38
34
33
40

COOLING DEVICE

CROSS-REFERENCE TO RELATED APPLICATION

This application claims the priority, under 35 U.S.C. § 119, of European Patent Applications EP 14 003 245.9, filed Sep. 18, 2014 and EP 15 000 255.8, filed Jan. 28, 2015; the prior applications are herewith incorporated by reference in their entireties.

BACKGROUND OF THE INVENTION

Field of the Invention

The invention relates to a cooling device for cooling a detector element disposed in a jacket cavity of a Dewar vessel by using a Joule-Thomson cooler with an expansion nozzle that opens into an expansion chamber, in which the cooling device includes a temperature-dependently adjustable control element for influencing a flow through the expansion nozzle.

A cooling device of the above-mentioned type is e.g. known from European Patent Application EP 06 99 881 A2. The control element disclosed therein includes a choke body acting on the expansion nozzle, which is biased against a heatable shape memory element by using a restoring spring. The choke body is controllable depending on temperature in the sense of increasing the flow through the expansion nozzle in the event of an increase of the temperature of the detector element. A suitable temperature sensor for detecting the detector temperature is disposed on the detector.

A cooling device of the above-mentioned type is also known from European Patent Application EP 06 99 880 A2. There the control element provided for influencing the flow through the expansion nozzle includes a support fed into a bellows. The same can be altered in shape by using a pressure chamber enveloping the bellows. The detector temperature is also used in this case as a control input for the temperature regulation. A suitable temperature sensor is disposed on the detector element for that purpose.

Cooling devices of the type described above are used to cool detectors to low temperatures. Detectors, such as e.g. semiconductor detectors, only reach their optimal radiation sensitivity at temperatures far below room temperature. Therefore, suitable cooling is necessary.

In the case of a cooling device of the above-mentioned type, the detector element is disposed in a jacket cavity of a Dewar vessel. An inlet window is disposed in the outer casing on the detector-side end of the Dewar vessel, in which case the window passes the radiation to be detected by the detector element. For example, the inlet window is made of a material that is transmissive for infrared (IR) radiation if the detector element is an IR detector.

A Joule-Thomson cooler is disposed on the rear of the detector element in the interior of the Dewar vessel. A pressurized gas or general coolant that is fed in is expanded at the expansion nozzle and as a result cools according to its Joule-Thomson thermal coefficients into a region close to its boiling temperature. For example, argon, nitrogen or air, having boiling temperatures which lie below 100 K, can be used as pressurized gases.

Semiconductor detectors and especially IR detectors have to be operated at very low temperatures. In particular, that applies to so-called MCT detectors, which can be made from an alloy of mercury, cadmium and tellurium. Furthermore, during the recording period very high temperature stability is advantageous.

Disadvantageously, the cooling devices of the prior art exhibit a relatively large time constant for the control loop. The temperature sensor is disposed on the detector element in the jacket cavity of the Dewar vessel. Accordingly, the achievable temperature stability is limited. On the other hand, actively regulated cooling devices can to date only be operated at temperatures of approximately 5° K. above the boiling temperature of the pressurized gas being used and thus in the gas phase. The control temperature is limited by the boiling temperature. A change of cooling power directly causes a change of temperature.

SUMMARY OF THE INVENTION

It is accordingly an object of the invention to provide a cooling device, which overcomes the hereinafore-mentioned disadvantages of the heretofore-known devices of this general type and which is improved with regard to temperature stability and an achievable low temperature.

With the foregoing and other objects in view there is provided, in accordance with the invention, a cooling device for cooling a detector element disposed in a jacket cavity of a Dewar vessel by using a Joule-Thomson cooler with an expansion nozzle opening into an expansion chamber, wherein the cooling device includes a temperature-dependently adjustable final control element for influencing a flow through the expansion nozzle, a first temperature sensor disposed in the expansion chamber, a second temperature sensor disposed within the Dewar vessel outside of the expansion chamber, and a control device configured for recording a temperature gradient from sensor values of the first temperature sensor and of the second temperature sensor and for adjustment of the final control element depending on the recorded temperature gradient.

The invention is based on the consideration that the Joule-Thomson cooler is operated with a liquid phase in the expansion chamber in order to make use of the inherent temperature stability as a result of the boiling temperature of the pressurized gas. Improved temperature stability of the cooling device is achieved in that way. Regulatable and/or controllable operation of the Joule-Thomson cooler with a liquid phase in the expansion chamber is possible by recording a temperature gradient between the expansion chamber and a quasi-stable temperature level outside the expansion chamber. For this purpose a first temperature sensor is disposed in the expansion chamber and a second temperature sensor is disposed outside the expansion chamber in the Dewar vessel. A quasi-stable temperature gradient is formed along the Dewar vessel between the low temperature at the detector end and room temperature at the other end. A quasi-stable temperature level is recorded within the gradient by using the second temperature sensor. The term "quasi-stable" means in this context that the time constant of the temperature profile is negligibly small in comparison with time constants of the control path.

The recorded temperature gradient is a measure of the degree of wetting of the first temperature sensor that is disposed in the expansion chamber. The degree of wetting of the first temperature sensor is in turn a measure of the mixing ratio of liquefied pressurized gas and gaseous pressurized gas in the expansion chamber. The flow conditions in the expansion chamber are turbulent, so that good mixing of the gas phase and the liquid phase results and good use of the temperature sensor is ensured.

The temperature information or the information about the recorded temperature gradient and thus about the state of cooling of the cooling device can be used in a control loop in order to keep the mixture ratio of the gas phase and the liquid phase in the expansion chamber within a defined range. The time constant of the regulation is reduced as compared to a regulation of the prior art, according to which the detector temperature is used as a control input. The recorded temperature gradient responds directly to a change of the mixing ratio of the gas phase and the liquid phase in the expansion chamber.

The invention enables the cooling device or the Joule-Thomson cooler to operate at the boiling temperature of the pressurized gas being used. At the same time high temperature stability is achieved with the principle described because the inherent temperature stabilization due to the boiling temperature is exploited. The cooling temperature is basically only dependent on the counterpressure in the gas outlet and hence on the variation of the gas throughput. In the case of a suitable configuration of the gas outlet or the counterflow heat exchanger that is usually used in this case, changes in pressure are negligible.

In accordance with another feature of the invention, the second temperature sensor is preferably disposed separately from the expansion chamber in an inner rear chamber of the Dewar vessel. A quasi-stable temperature level is ensured in the interior of the Dewar vessel.

In accordance with a further advantageous feature of the cooling device of the invention, a hollow tube that is enveloped by a counterflow heat exchanger is disposed within the Dewar vessel, wherein the rear chamber, in which the second temperature sensor is located, is disposed within the hollow tube. A pressurized gas line is provided between the hollow tube and the inner wall of the Dewar vessel in a normal implementation, with the line running helically around the hollow tube and opening in the expansion nozzle. The expanded pressurized gas flows around the pressurized gas line in the counterflow direction and exits the cooling device at its end remote from the detector element. In the Dewar vessel during operation, between the end of the detector and the end remote from the detector element there is a stable temperature drop between the low temperature in the expansion chamber and room temperature at the gas outlet.

The final control element can be of any construction in principle. In accordance with an added preferred feature of the invention, the final control element includes a choke body and a shape memory element connected to the choke body. A shape memory element has, in particular, a temperature-dependent change in shape or change in length, which is significantly increased compared to the material-specific temperature response. That change in shape or change in length of a shape memory element is used for regulation and/or control of the flow through the expansion nozzle. The shape memory element is e.g. made of a metal alloy, which has a transition between a martensitic phase and an austenitic phase in the temperature range in which it is used. NiTi, CuZnAl or CuAlNi can be used as a suitable metal alloy. The choke body joined to the shape memory element affects the expansion nozzle to influence the flow accordingly. The shape memory element is especially heatable for temperature-dependent regulation of the flow at the expansion nozzle.

In accordance with an additional useful feature of the invention, a third temperature sensor is disposed on the detector element, and the control device is additionally configured for detecting a detector temperature using the sensor value of the third temperature sensor and for adjusting the final control element depending on the detected detector temperature.

In accordance with yet another advantageous feature of the invention, the control device is configured in such a way that the detector temperature is used as a control input in an outer control loop for the control element and the temperature gradient is used as a control input in an inner control loop for the control element. The regulator thus is formed of an inner control loop and an outer control loop. As a result the achievable temperature stability of the cooling device is further improved.

In accordance with a concomitant advantageous feature of the invention, the first temperature sensor and the second temperature sensor are disposed at the ends of a temperature probe, which protrudes with its first end into the expansion chamber and extends within the Dewar vessel to outside the expansion chamber with its second end. The temperature gradient is thus directly detected by using the temperature probe. The temperature gradient and thus the regulation sensitivity becomes greater as the thermal conductivity of the material used for the temperature probe becomes poorer. For example, stainless steel is preferably used as the material for the temperature probe.

Other features which are considered as characteristic for the invention are set forth in the appended claims.

Although the invention is illustrated and described herein as embodied in a cooling device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SINGLE VIEW OF THE DRAWING

The FIGURE of the drawing is a diagrammatic, longitudinal-sectional view of an exemplary embodiment of a cooling device of the invention for cooling a detector element disposed in a jacket cavity of a Dewar vessel by using a Joule-Thomson cooler.

DETAILED DESCRIPTION OF THE INVENTION

Referring now in detail to the single FIGURE of the drawing, there is seen a cooling device 1 which includes a Joule-Thomson cooler 2 for cooling a detector element 3 in a Dewar vessel 4. The detector element 3 of the cooling device 1 is disposed in a jacket cavity 5 of the Dewar vessel 4. An inlet window 7 is inserted into an outer casing on a detector side of the Dewar vessel 4. The inlet window 7 is transmissive for radiation that is to be detected by the detector element 3. In particular, the inlet window 7 is transmissive for IR radiation if the detector element 3 is an IR detector.

A hollow tube 9 is disposed in the interior of the Dewar vessel 4. A counterflow heat exchanger 10 is formed between the hollow tube 9 and an inner wall of the Dewar vessel 4. A pressurized gas line 12 runs helically around the hollow tube 9. The pressurized gas line 12 is supplied from a gas connector 13. The pressurized gas line 12 opens in an expansion nozzle 15 on the detector side.

The pressurized gas delivered through the pressurized gas line 12 expands there in an expansion chamber 16. Expanded pressurized gas flows from the expansion chamber 16 in the counterflow direction over the outside of the pressurized gas line 12 to the end of the cooling device 1 facing away from the detector element 3 and exits the cooling device through a gas outlet 18, 19.

The pressurized gas is expanded at the expansion nozzle 15 and as a result cools according to its Joule-Thomson thermal coefficient. The expansion chamber 16 and thus the detector element 3 is thereby cooled by thermal conduction at its rear. The illustrated cooling device 1 is thereby operated in such a way that there is a mixture of the gas phase and the liquid phase of the pressurized gas in the expansion chamber 16. In other words, the cooling device 1 is operated in the region of the boiling temperature of the pressurized gas, whereby temperature stabilization is inherently set up.

A final control element 22 is disposed in the hollow tube 9 for the control and/or regulation of the flow through the expansion nozzle 15. The final control element 22 includes a choke body 23 acting on the expansion nozzle 15, which is connected to a shape memory element 25. The choke body 23 is thereby biased against a thrust bearing element 28 by a restoring spring 27. The temperature-dependent influencing of the flow in the expansion nozzle 15 takes place by using a change of length of the shape memory element 25. The shape memory element 25 is especially heatable for regulation.

A temperature probe 30 which is also disposed in the interior of the Dewar vessel 4 has a first end 31 that protrudes into the expansion chamber 16. The temperature probe 30 has a second end 32 which is mounted on the thrust bearing element 28. A rear chamber 33 is formed within the hollow tube 9 in the region of the final control element 22 and is separated from the expansion chamber 16.

A first temperature sensor 34 is disposed at the first end 31 of the temperature probe 30. A second temperature sensor 35 is disposed at the second end 32 of the temperature probe 30 in the rear chamber 33. Whereas the first temperature sensor 34 measures the temperature in the expansion chamber or its degree of wetting with liquefied pressurized gas, the second temperature sensor 35 detects a quasi-stable temperature level on the thrust bearing element 28. In the Dewar vessel 4 or in the hollow tube 9 a quasi-stable temperature drop is formed along the cooling device 1 between the low temperature on the detector side and room temperature on the side remote from the detector element 3.

The temperature gradient along the temperature probe 30 is a measure of the degree of wetting. The degree of wetting in turn is a measure of the mixing ratio of the liquid phase and the gas phase of the pressurized gas in the expansion chamber 16. The temperature gradient is particularly sensitive to a change of the mixing ratio and can thus be used with relatively small time constants as a control input for the regulation of the flow through the expansion nozzle 15 by using the final control element 22. This regulation enables the operation of the cooling device 1 at the boiling temperature of the pressurized gas. The mixing ratio of the liquid phase and the gas phase can be adjusted in the expansion chamber 16. High temperature stabilization is achieved.

Furthermore, a third temperature sensor 37 is disposed on the detector element 3 for detecting the detector temperature. The detector temperature can also be used for regulation of the flow through the expansion nozzle 15. Additionally, a fourth temperature sensor 38 is disposed on the end of the cooling device 4 facing away from the detector element 3.

A control device 40 is provided for the control and/or regulation of the cooling device 1. The control device 40 is especially configured to use the temperature gradient along the temperature probe 30 as a control input for the control element 22 in an inner control loop and to use the detector temperature as a control input for the control element 22 in an outer control loop.

The invention enables improved temperature stability in comparison to the prior art. The cooling device can be operated closer to the boiling temperature or at the boiling temperature itself because of the reduced time constants in the control loop compared to the prior art.

The invention claimed is:

1. A cooling device for cooling a detector element disposed in a jacket cavity of a Dewar vessel, the cooling device comprising:

a Joule-Thomson cooler having an expansion nozzle opening into an expansion chamber in the Dewar vessel;

a final control element being adjustable in dependence on temperature for influencing a flow through said expansion nozzle;

a first temperature sensor disposed in the expansion chamber;

a second temperature sensor disposed within the Dewar vessel outside the expansion chamber; and a controller configured for detecting a temperature gradient from sensor values of said first temperature sensor and of said second temperature sensor and for adjusting said final controller in dependence on said detected temperature gradient.

2. The cooling device according to claim 1, wherein said second temperature sensor is disposed separately from the expansion chamber in an inner rear chamber of the Dewar vessel.

3. The cooling device according to claim 2, which further comprises:

a hollow tube disposed within the Dewar vessel; and a counterflow heat exchanger enveloping said hollow tube;

the rear chamber containing said second temperature sensor being disposed within said hollow tube.

4. The cooling device according to claim 1, which further comprises:

a temperature probe having a first end protruding into the expansion chamber and a second end extending within the Dewar vessel to outside the expansion chamber;

said first temperature sensor and said second temperature sensor each being disposed at a respective one of said ends of said temperature probe.

5. The cooling device according to claim 1, wherein said final control element includes the choke body and the shape memory element connected to said choke body.

6. The cooling device according to claim 1, which further comprises:

a third temperature sensor disposed on the detector element;

said controller being additionally configured for detecting a detector temperature using a sensor value of said third temperature sensor and for adjusting said final control element depending on said detected detector temperature.

7. The cooling device according to claim 6, which further comprises:

an outer control loop and an inner control loop for said final control element;

said controller being configured to use the detector temperature as a control input in said outer control loop and to use the temperature gradient as a control input in said inner control loop for the control element.

* * * * *